United States Patent [19]

May et al.

[11] Patent Number: 4,990,955

[45] Date of Patent: Feb. 5, 1991

[54] WHITE LEVEL STABILIZATION FOR TRI-LEVEL IMAGING

[75] Inventors: Jerome E. May; Delmer G. Parker, both of Rochester; Howard M. Stark, Webster, all of N.Y.

[73] Assignee: Xerox Corporation, Stamford, Conn.

[21] Appl. No.: 335,343

[22] Filed: Apr. 10, 1989

[51] Int. Cl.[5] ..... G03G 15/04; G03G 15/01

[52] U.S. Cl. ..... 355/208; 355/214; 355/328; 430/31; 430/42

[58] Field of Search ..... 355/208, 214, 216, 219, 355/228, 328; 430/30, 31, 42, 45; 346/160

[56] References Cited

U.S. PATENT DOCUMENTS

| | | | |
|---|---|---|---|
| 3,788,739 | 1/1974 | Coriale | 355/219 X |
| 4,078,929 | 3/1978 | Gundlach | 430/42 |
| 4,855,766 | 8/1989 | Suzuki | 355/214 X |

FOREIGN PATENT DOCUMENTS

| | | | |
|---|---|---|---|
| 63-296062 | 12/1988 | Japan | 355/216 |

*Primary Examiner*—Joan H. Pendegrass

[57] ABSTRACT

Stabilization of the white or background discharge voltage level of tri-level images is accomplished by monitoring photoreceptor white discharge level in the interdocument area of the photoreceptor using an electrostatic voltmeter. The information obtained thereby is utilized to control the output of a raster output scanner so as to maintain the white discharge level at a predetermined level.

7 Claims, 2 Drawing Sheets

WHITE LEVEL STABILIZATION FOR TRI-LEVEL IMAGING

CROSS-REFERENCE

Patent application Ser. No. 335,344, entitled "Adaptive Bias Control For Tri-Level Xerography" filed in the name of May et al in the USPTO on the same date as the present application and assigned to the same assignee as the instant invention.

BACKGROUND OF THE INVENTION

This invention relates generally to tri-level imaging and more particularly to a method and apparatus for maintaining or stabilizing the white discharge level of a tri-level image at a predetermined voltage level.

In the practice of conventional xerography, it is the general procedure to form electrostatic latent images on a charge retentive surface such as a photoconductive member by first uniformly charging the charge retentive surface. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, not only are the charged (i.e. unexposed) areas developed with toner but the discharged (i.e., fully exposed) images are also developed. Thus, the charge retentive surface contains three voltage levels which correspond to two image areas and to a background voltage area. One of the image areas corresponds to non-exposed (i.e. charged) areas of the photoreceptor, as in the case of conventional xerography, while the other image areas correspond to fully exposed (i.e., discharged) areas of the photoreceptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD) remains at or near the fully charged photoreceptor potential represented by $V_{cad}$ or $V_{ddp}$ as shown in FIG. 1*a*. The other images are formed by discharging the photoreceptor to its residual potential, i.e. $V_{dad}$ of $V_c$ (typically 100 v) which corresponds to discharged area images that are subsequently developed by discharged-area development (DAD). The background areas are formed by discharging the photoreceptor to reduce its potential to halfway between the $V_{cad}$ and $V_{dad}$ potentials, (typically 500 v) and is referred to as $V_{white}$ or $V_w$. The CAD developer is typically biased about 100 v ($V_{bb}$, shown in FIG. 1*b*) closer to $V_{cad}$ than $V_{white}$ resulting in a $V_{bb}$ of about 600 v, and the DAD developer system is biased about 100 v ($V_{cb}$, shown in FIG. 1*b*) closer to $V_{dad}$ than $V_{white}$ resulting in a $V_{cb}$ of about 400 v.

As developed, the composite tri-level image initially consists of both positive and negative toners. To enable conventional corona transfer, it is necessary to first convert the entire image to the same polarity. This must be done without overcharging the toner that already has the correct polarity for transfer. If the amount of charge on the toner becomes excessive, normal transfer will be impaired and the coulomb forces may cause toner disturbances in the developed image. On the other hand, if the toner whose polarity is being reversed is not charged sufficiently its transfer efficiency will be poor and the transferred image will be unsatisfactory.

It has been observed that the aforementioned white level voltage, $V_w$ shifts differentially along the length of a photoreceptor due to variation in the charge acceptance level caused by manufacturing variations. Moreover, as a photoreceptor ages, its charge acceptance level deteriorates. To compensate for decreased charge acceptance level the photoreceptor is charged to a higher voltage level which causes shifting of the white level.

Also the element utilized for charging the charge retentive surface can become contaminated leading to reduced charging and shifting of the white level. Variation in the exposure output ROS utilized in electronically forming the tri-level image causes changes in the white level.

If the white level voltage, $V_w$ of a tri-level image drifts up or down as a result of fluctuations in the photoreceptor charge acceptance level, charging or white level exposure or any combination of the foregoing, the balance between the charged area (CAD) image represented by voltage $V_{ddp}$ ($V_{cad}$) and the discharged area (DAD) image represented by $V_c$ ($V_{dad}$)) will be upset. If the white level moves toward the discharged area image, the cleaning field for the charged image area will increase and at the same time the cleaning field for the discharged image area will decrease. This results in a tendency for less background suppression in the discharged image area and attenuation of fine line image in the charged image area.

BRIEF SUMMARY OF THE INVENTION

The white discharge level in a tri-level image is stabilized by monitoring the white discharge level in the inter-document zone with an electrostatic voltmeter (ESV) and using the information derived to control an exposure device such as a raster output scanner (ROS) so as to maintain the white discharge level at some predetermined voltage level. To this end an ESV is positioned immediately following the ROS exposure station. This permits immediate updating of the white level exposure for the adjacent print frame following the inter-document zone being monitored by the ESV. The update can be based on one or more inter-document white level measurements and/or a prior knowledge of the photoreceptor (P/R) characteristics. The white level exposure is not corrected within a print frame in order to avoid unnecessary within-print background gradients.

DETAILED DESCRIPTION OF THE PREFERRED EMBODIMENT OF THE INVENTION

Figure 2:
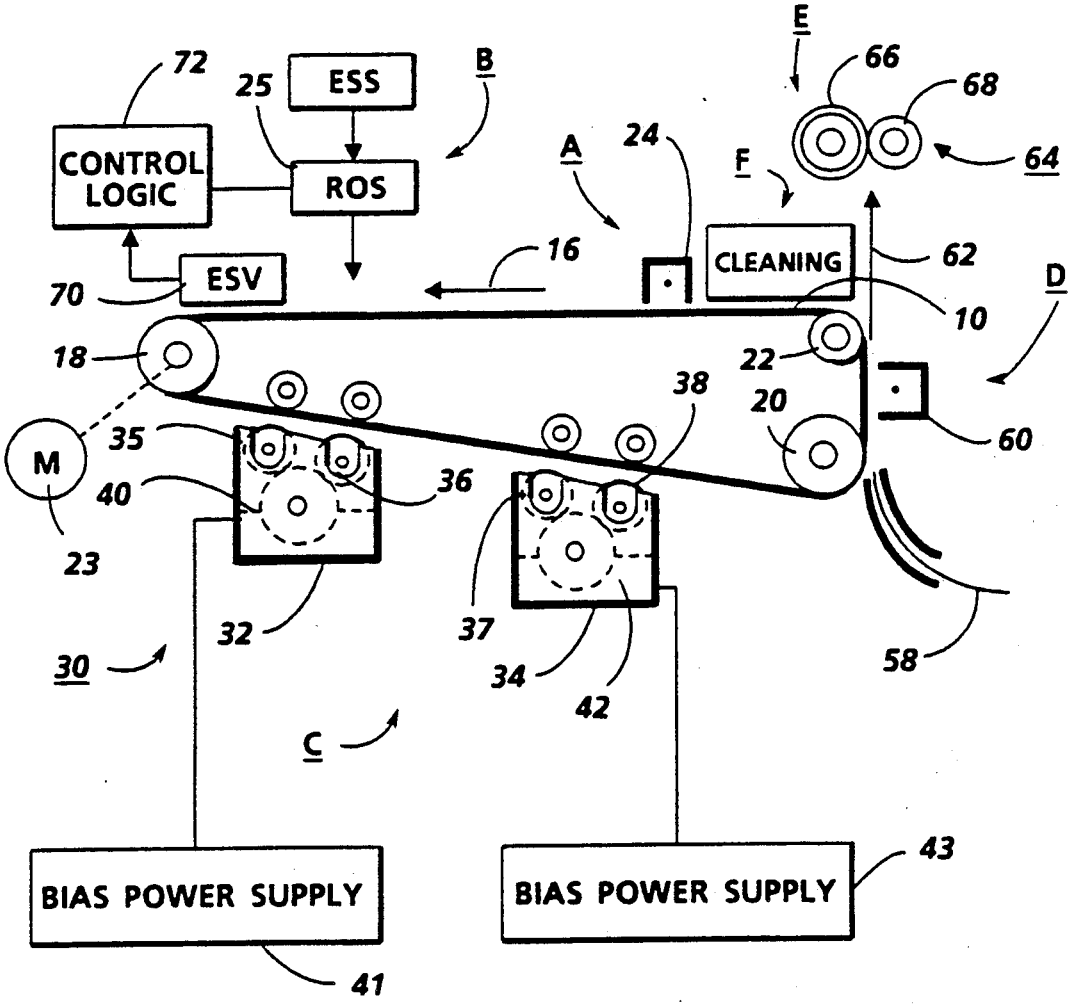
FIG. 2 is a schematic illustration of a printing apparatus incorporating the inventive features of the invention.

As shown in FIG. 2, a printing machine incorporating the invention may utilize a charge retentive member in the form of a photoconductive belt 10 consisting of a photoconductive surface and an electrically conductive, light transmissive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Figure 1A:
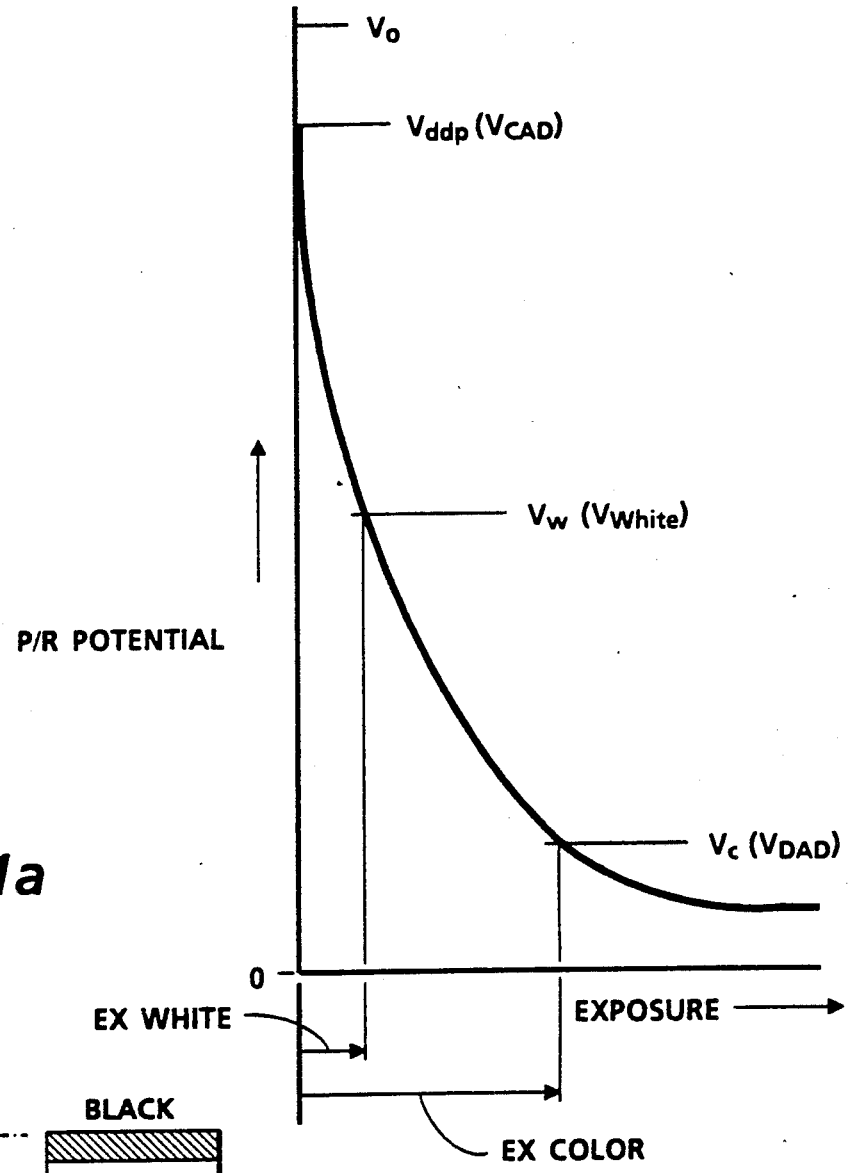
FIG. 1*a* is a plot of photoreceptor potential versus exposure illustrating a tri-level electrostatic latent image.
Figure 1B:
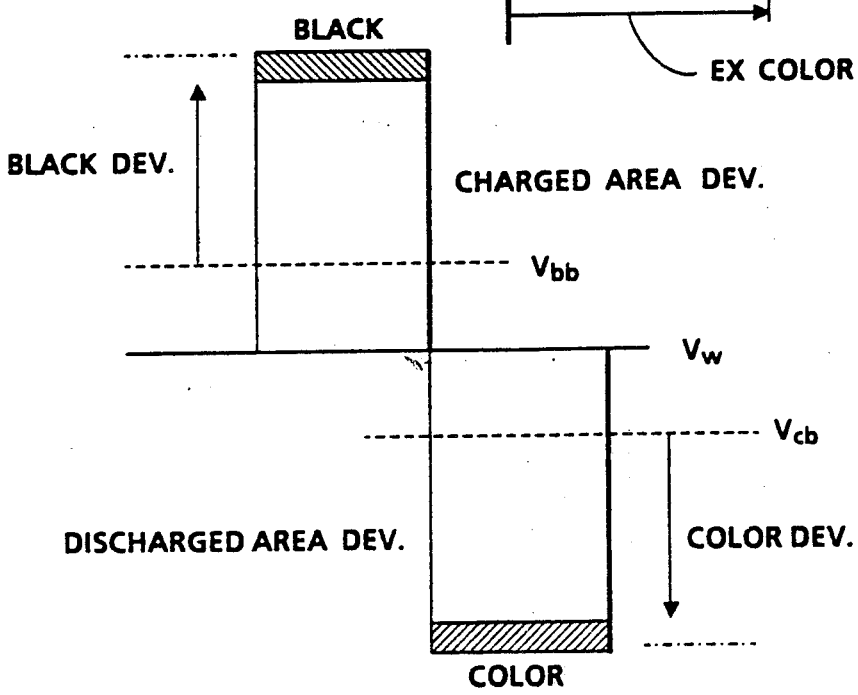
FIG. 1*b* is a plot of photoreceptor potential illustrating single-pass, highlight color latent image characteristics.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three-level laser Raster Output Scanner (ROS). The resulting photoreceptor contains both charged-area (CAD) images and discharged-area images (DAD) as well as background areas designated as $V_w$ in FIGS. 1*a* and 1*b*.

The photoreceptor, which is initially charged to a voltage $V_0$, undergoes dark decay to a level $V_{ddp}$ ($V_{cad}$) equal to about −900 volts. When exposed at the exposure station B it is discharged to $V_c$, ($V_{dad}$) equal to about −100 volts in the highlight (i.e. color other than black) color parts of the image. See FIG. 1*a*. The photoreceptor is also discharged to $V_w$ ($V_{white}$) equal to −500 volts imagewise in the background (white) image areas and in the inter-document area. After passing through the exposure station, the photoreceptor contains charged areas and discharged areas which corresponding to CAD and DAD latent images.

At development station C, a development system, indicated generally by the reference numeral 30 advances developer materials into contact with the CAD and DAD electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the charged-area images. The developer material 40 by way of example contains positively charged black toner. Electrical biasing is accomplished via power supply 41 electrically connected to developer apparatus 32. A DC bias of approximately −600 volts is applied to the rollers 35 and 36 via the power supply 41.

The developer apparatus 34 comprises a housing containing a pair of magnetic rolls 37 and 38. The rollers advance developer material 42 into contact with the photoreceptor for developing the discharged-area images. The developer material 42 by way of example contains negatively charged red toner for developing the discharged-area images. Appropriate electrical biasing is accomplished via power supply 43 electrically connected to developer apparatus 34. A suitable DC bias of approximately −400 volts is applied to the rollers 37 and 38 via the bias power supply 43.

Because the composite image developed on the photoreceptor consists of both positive and negative toner a positive pre-transfer corona discharge member (not shown) is provided to condition the toner for effective transfer to a substrate using positive corona discharge. The pre-transfer corona discharge member is preferably an ac corona device biased with a dc voltage to operate in a field sensitive mode and to perform tri-level xerography pre-transfer charging in a way that selectively adds more charge (or at least comparable charge) to the part of composite tri-level image that must have its polarity reversed compared to elsewhere. This charge discrimination is enhanced by discharging the photoreceptor carrying the composite developed latent image with light before the pre-transfer charging begins. Furthermore, flooding the photoreceptor with light coincident with the pre-transfer charging minimizes the tendency to overcharge portions of the image which are already at the correct polarity.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contracting the upper most sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Stabilization of the white or background discharge voltage level is accomplished by monitoring photoreceptor white discharge level in the inter-document area of the photoreceptor using an electrostatic voltmeter (ESV) 70. The information obtained thereby is utilized by control logic 72 to control the output of a raster output scanner so as to maintain the white discharge level at a predetermined level.

The control logic 72 may comprise any well know element which provides a reference voltage representative of a predetermined white voltage level. The control logic compares the voltage value sensed by the ESV 70.to the predetermined value and generates a signal which is used to control the output of the ROS to thereby maintain the white discharge level at the predetermined level. Correction of the white level output of the raster output scanner is timed by the control logic such that correction is precluded from taking place within an image frame in order to avoid white level gradients in the image frame.

What is claimed is:

1. A method of creating tri-level images on a charge retentive surface, said method including the steps of:

uniformly charging said charge retentive surface;

exposing said uniformly charged surface to form charged-area images, discharged-area images and white discharge areas;

generating signals representative of the white discharge level on said charge retentive surface;

utilizing said signals for controlling said exposing step for maintaining said white discharge level at a predetermined level said step of exposing comprising exposing said uniformly charged surface to a three level raster output scanner to form tri-level images spaced apart by an inter-document white discharge level area; and said signal generating step comprising monitoring the interdocument white discharge level voltage level and generating an output signal representing said white discharge level voltage.

2. The method according to claim 1 wherein said signal output utilizing step comprises utilizing said output signals for controlling said exposing step for maintaining said white discharge level at a predetermined level.

3. The method according to claim 2 wherein said output signal is utilized such that the white level output of said scanner is not varied while a tri-level image is being formed thereby avoiding white level gradients in the image areas.

4. The method according to claim 3 wherein said predetermined level is approximately 400 volts.

5. Apparatus for creating tri-level images on a charge retentive surface, said apparatus comprising:

means for uniformly charging said chargere tentive surface;

means for exposing said uniformly charged surface to form charged-area images, discharged-area images and white discharge level areas;

means for generating signals representative of the white discharge level on said charge retentive surface;

means for utilizing said signals for controlling said exposing means for maintaining said white discharge level at a predetermined level said exposing means comprising means for exposing said uniformly charged surface to a three-level raster output scanner to form trilevel images spaced apart by an inter-document white discharge level area; and said signal generating means comprising means for monitoring the inter-document white discharge level voltage and generating output signals representing said white discharge level voltage

6. Apparatus according to claim 5 wherein said output signals are utilized such that the white level output of said scanner is not varied while a tri-level image is being formed thereby avoiding white level gradients in the image areas.

7. Apparatus according to claim 6 wherein said predetermined level is approximately 400 volts.

* * * * *